US005710096A

United States Patent [19]

Ohnishi et al.

[11] Patent Number: 5,710,096

[45] Date of Patent: Jan. 20, 1998

[54] THERMAL TRANSFER IMAGE-RECEIVING SHEET

[75] Inventors: Jiro Ohnishi; Masayasu Yamazaki, both of Tokyo-To, Japan

[73] Assignee: Dai Nippon Printing Co., Ltd., Japan

[21] Appl. No.: 424,071

[22] Filed: Apr. 19, 1995

[30] Foreign Application Priority Data

Apr. 22, 1994 [JP] Japan ..... 6-107541

[51] Int. Cl.[6] ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS

| | | | |
|---|---|---|---|
| 5,095,002 | 3/1992 | Beck et al. | 503/227 |
| 5,116,805 | 5/1992 | Pope et al. | 503/227 |
| 5,214,024 | 5/1993 | Beck et al. | 503/227 |
| 5,256,621 | 10/1993 | Yasuda et al. | 503/227 |
| 5,296,443 | 3/1994 | Suto | 503/227 |

FOREIGN PATENT DOCUMENTS

| | | | |
|---|---|---|---|
| 0409526 | 1/1991 | European Pat. Off. | 503/227 |
| 4-33894 | 2/1992 | Japan | 503/227 |
| WO 94/05506 | 3/1994 | WIPO | 503/227 |

*Primary Examiner*—Bruce H. Hess

*Attorney, Agent, or Firm*—Parkhurst & Wendel

[57] ABSTRACT

The present invention provides a thermal transfer image-receiving sheet which is not influenced by environmental conditions, such as temperature and humidity, gives rise to no deterioration in the above effect during and even after the formation of an image and always exhibits a high antistatic property. The thermal transfer image-receiving sheet includes a substrate sheet and a receptive layer provided on at least one surface thereof, the substrate sheet having a surface resistivity of not more than $1\times10^{12}$ Ω/□ as measured under environmental conditions of a temperature of 20° C. and a humidity of 50%, a conductive intermediate layer being provided between the substrate sheet and the receptive layer, a layer containing a conductive material being provided on both the outermost surfaces of the substrate sheet.

6 Claims, No Drawings

THERMAL TRANSFER IMAGE-RECEIVING SHEET

BACKGROUND OF THE INVENTION

The present invention relates to a thermal transfer image-receiving sheet which is, when used, laminated onto a thermal transfer sheet. More particularly, it relates to a thermal transfer image-receiving sheet which is not influenced by environmental conditions, such as temperature and humidity, and always exhibits stable antistatic effect during and even after the formation of an image.

Various thermal transfer recording systems are known in the art. Among others, a sublimation dye transfer recording system, where a thermal transfer sheet comprising a support, such as a polyester film, bearing thereon a thermal transfer layer containing a sublimable dye is heated by means of a heating medium, such as a thermal head or a laser beam, to form a dye image on a recording medium, is used as information recording means in various fields.

According to this system, a full-color image of an original can be reproduced by heating for a very short period of time. Further, the resultant image has high sharpness and excellent transparency, offering excellent half tone reproduction and gradation. By virtue of this nature, it is possible to form an image having a high quality comparable to that of a full-color photographic image.

In the above system, the recording medium comprises paper or a plastic film as a substrate and, provided thereon, a receptive layer composed of a dyeable resin layer. For this recording medium, in order to prevent carrying troubles or the like derived from static electricity, it is common practice to provide a resin layer formed of a resin with an antistatic agent being incorporated therein or to coat an antistatic agent on the surface of the recording medium.

For a method wherein a resin layer with an antistatic agent being incorporated therein is formed, however, the amount of the antistatic agent which can be added to the resin layer is small, offering no significant effect. On the other hand, for a method wherein an antistatic agent is coated on the surface of the recording medium, no satisfactory antistatic effect can be attained because, due to environmental conditions, such as temperature and humidity, unfavorable phenomena occur including that the antistatic effect is substantially lost, the antistatic agent on the surface of the recording medium migrates to the thermal transfer sheet during the formation of an image or the antistatic property is deactivated due to heating during the formation of an image. These are causative of carrying troubles.

Further, as described in Japanese Patent Laid-Open Nos. 144128/1980, 82597/1991, and 33894/1992, a method is proposed wherein a conductive material is used as an intermediate layer provided on the side of the image-receiving face. This method can prevent, to some extent, influence of environments and a change in antistatic property between before and after printing. Here again, however, the antistatic effect is not satisfactory, and once the recording medium is electrified by strong friction or the like, the charge attenuation is slow, so that the carrying trouble cannot be prevented.

DISCLOSURE OF THE INVENTION

Accordingly, an object of the present invention is to solve the problems of the prior art and to provide a thermal transfer image-receiving sheet which is not influenced by environmental conditions, such as temperature and humidity, gives rise to no deterioration in the above effect during and even after the formation of an image and always exhibits a high antistatic property.

According to the present invention, the above problem can be solved by a thermal transfer image-receiving sheet comprising a substrate sheet and a receptive layer provided on at least one surface thereof, said substrate sheet having a surface resistivity of not more than $1.0\times10^{12}$ Ω/□ as measured under environmental conditions of a temperature of 20° C. and a humidity of 50%, a conductive intermediate layer being provided between the substrate sheet and the receptive layer, a layer containing a conductive material being provided on both the outermost surfaces of the substrate sheet.

The formation of an intermediate layer, containing a conductive material, between the substrate sheet and the receptive layer can suppress a change in antistatic effect derived from environmental conditions, such as temperature and humidity, or caused in the course of formation of an image, and the use of a substrate sheet having a surface resistivity of not more than $1.0\times10^{12}$ Ω/□ as measured under environmental conditions of a temperature of 20° C. and a humidity of 50% and coating of a conductive material on both the outermost surfaces can sufficiently enhance the above effect, thereby providing a thermal transfer image-receiving sheet which can always exhibit stable carriability.

BEST MODE FOR CARRYING OUT THE INVENTION

The thermal transfer image-receiving sheet of the present invention will now be described in detail. It comprises a substrate sheet having a surface resistivity of not more than $1.0\times10^{12}$ Ω/□ as measured under environmental conditions of a temperature of 20° C. and a humidity of 50%; an intermediate layer, containing a conductive material, between the substrate sheet and the receptive layer; and a layer, containing a conductive material, provided on both the outermost surfaces of the substrate sheet.

Substrate sheet

In the present invention, the substrate sheet has a surface resistivity of not more than $1.0\times10^{12}$ Ω/□ as measured under environmental conditions of a temperature of 20° C. and a humidity of 50%. The term "surface resistivity" used herein is "a value determined by dividing a potential gradient in a direction parallel to a current flowing along the surface of a specimen by a current per unit width of the surface of the specimen," as defined in JIS K 6911. The surface resistivity is usually expressed in terms of Ω. In the present invention, however, it is expressed in terms of Ω/□ from the viewpoint of distinguishing the surface resistivity from mere resistance.

The substrate sheet serves to hold a receptive layer and, at the same time, since heat is applied at the time of formation of an image, preferably has good mechanical strength enough to be handled in a heated state without any problem.

Materials for the substrate sheet are not particularly limited, and examples thereof include capacitor paper, glassine paper, parchment paper, paper having a high sizing content, synthetic paper (polyolefin paper and polystyrene paper), wood-free paper, art paper, coated paper, cast-coated paper, wallpaper, backing paper, paper impregnated with a synthetic resin or an emulsion, paper impregnated with a synthetic rubber latex, paper with a synthetic resin internally added thereto, paper board, cellulosic fiber paper, and films of polyester, polyacrylate, polycarbonate, polyurethane, polyimide, polyetherimide, cellulose derivative, polyethylene, ethylene/vinyl acetate copolymer, polypropylene, polystyrene, acrylic resin, polyvinyl chloride, polyvinylidene chloride, polyvinyl alcohol, polyvinyl butyral, nylon, polyetherether ketone, polysulfone, polyethersulfone, tetrafluoroethylene-perfluoroalkyl vinyl ether, polyvinyl fluoride, tetrafluoroethylene-ethylene, tetrafluoroethylene-hexafluoropropylene, polychlorotrifluoroethylene, and polyvinylidene fluoride. Further, it is also possible to use a white opaque film formed by adding a white pigment or a filler to the above synthetic resin and forming the mixture into a film, or a foamed sheet prepared by foaming the above synthetic resin, and, as described above, the materials for the substrate sheet is not particularly limited.

Furthermore, it is also possible to use a laminate comprising any combination of the above substrate sheets. Representative examples of such a laminate include a laminate comprising a cellulosic fiber paper and a synthetic paper and a laminate comprising a cellulosic fiber paper, a plastic film, and a synthetic paper.

A substrate sheet having a surface resistivity of not more than $1.0\times10^{12}$ Ω/□ as measured under environmental conditions of a temperature of 20° C. and a humidity of 50% is selected from among the above substrate sheets or alternatively prepared by subjecting any one of the above substrate sheets to antistatic treatment. The use of this substrate can enhance the effect of the conductive intermediate layer and, at the same time, can prevent occurrence of a trouble caused by static electricity at the time of production of an image-receiving sheet. When this substrate is not used, the effect of the conductive intermediate layer is insufficient under a low temperature and low humidity (for example, temperature 10° C. and humidity 10%) environment, often posing a carrying trouble and, further, a trouble occurs due to static electricity in the course of production of an image-receiving sheet.

In particular, when the image-receiving sheet is used as a sheet for OHP, a transparent sheet may be selected from the above sheets.

The thickness of the above substrates is usually in the range of about 3 to 200 μm. When the adhesion between the above substrate and a layer provided thereon is poor, the surface is preferably subjected to primer treatment or corona discharge treatment.

Conductive intermediate layer

The conductive intermediate layer contains a conductive material. Examples of the conductive material include fine particles of metal oxides, such as zinc oxide, titanium oxide, and tin oxide. The particle diameter of the fine particles is usually not more than 50 μm. However, when the image-receiving sheet of the present invention is used as a sheet for OHP, the conductive intermediate layer should be transparent. In this case, fine particles having a diameter of not more than 0.5 μm, preferably not more than 0.3 μm, are incorporated in the intermediate layer.

A dispersion of the above fine particles in a resin for forming an intermediate layer, such as a polyester resin, an acrylic resin, a vinyl resin, a cellulosic resin, a halogenated polymer, a polyolefin resin, a polystyrene resin, a polyamide resin, a polycarbonate resin, a polyvinyl acetal resin, or a polyvinyl alcohol resin, or a copolymer of the above monomers is used for constituting an intermediate layer containing a conductive material.

Further, for example, a conductive resin prepared by introducing a group having an antistatic effect, such as a quaternary ammonium salt, phosphoric acid, etosulfite, vinylpyrrolidone, or sulfonic acid, into a resin, such as an acrylic resin, a vinyl resin, or a cellulose resin, or copolymerizing the above group with the above resin may also be used as the conductive material. Preferably, these groups having an antistatic effect are introduced in a pendant form into the resin because they can be introduced in a high density into the resin to offer a particularly high antistatic effect. More specifically, conductive materials of the above type include Jurymer series manufactured by Nihon Junyaku Co., Ltd., Reolex series manufactured by Dai-ichi Kogyo Seiyaku Co., Ltd., and Elecond series (for example, Elecond PQ-50B) manufactured by Soken Chemical Engineering Co., Ltd.

For example, the above Elecond PQ-50B has the following structural formula:

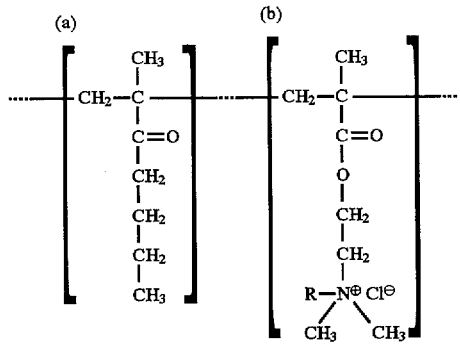

In the above structural formula, structural unit (a) represents butyl methacrylate, and structural unit (b) represents dimethylaminoethyl methacrylate. The constituent ratio of (a) to (b) is 1:1.

The above conductive resin, as such, may be used to form the intermediate layer. Alternatively, it may be used in the form of a mixture thereof with the above resin for forming an intermediate layer from the viewpoint of improving the layer strength and the adhesion to the substrate or other layers. When the conductive resin is used in a mixture form, the proportion of the conductive resin to the whole intermediate layer is preferably not less than 50% by weight. When the proportion is less than 50% by weight, there is a possibility that the antistatic effect is lowered, resulting in carrying trouble.

The provision of the above conductive intermediate layer enables the resultant image-receiving sheet to have a stable antistatic property during and even after printing, and the use of a combination of the conductive intermediate layer with a substrate having an antistatic property offers an antistatic property which is always stable and high without being influenced by environmental change. If the conductive intermediate layer is not provided, problems occur such as carrying troubles during printing, adhesion between image-receiving sheets due to static electricity and failure of the sheet to be fed.

Further, the conductive intermediate layer is preferably in a cured state from the viewpoint of improving the heat resistance. The use of an isocyanate as a curing agent unfavorably affects the antistatic effect of the conductive intermediate layer, and, therefore, a conductive resin which self-crosslinks is preferably used.

The use of a conductive resin having a glass transition point of 40° C. or above is also preferred.

Second intermediate layer

Preferably, a heat-resistant second intermediate layer is further provided between the substrate sheet and the intermediate layer containing the above conductive material and/or between the intermediate layer containing the above conductive material and the above receptive layer. The heat-resistant second intermediate layer may be a resin layer having a glass transition temperature of 60° C. or above or a resin layer which has been cured with a curing agent.

The formation of the second intermediate layer can improve the storage stability of the thermal transfer image-receiving sheet and, when a number of thermal transfer image-receiving sheets are stored in a superimposed form, can prevent the adhesion between the thermal transfer image-receiving sheets and improve the cushioning of the thermal transfer image-receiving sheets, which prevents the occurrence of nonuniform density or cockle derived from nonuniform printing pressure of a thermal head during printing.

Image-receiving layer

A receptive layer serves to receive a dye which, upon heating, is transferred from a thermal transfer sheet and, at the same time, to hold thereon a formed image. Resins for forming the receptive layer include, for example, polyolefin resins, such as polypropylene; halogenated polymers, such as polyvinyl chloride and polyvinylidene chloride; vinyl resins, such as polyvinyl acetate and polyacrylic esters; polyester resins, such as polyethylene terephthalate and polybutylene terephthalate; polystyrene resins; polyamide resins; ionomers; cellulosic resins, such as cellulose acetate; polycarbonate resins; polyvinyl acetal resins; polyvinyl alcohol resins; and resins of copolymers of the above resins or monomers thereof, for example, vinyl chloride/vinyl acetate copolymer and ethylene/vinyl acetate copolymer.

The above receptive layer may have either a single layer structure or a multi-layer structure.

The use of a cured resin layer as the receptive layer is preferred because surface roughening at the time of printing can be prevented. The cured resin layer may be formed of a product of a reaction of at least one resin, which is prepared by modifying the above resin with a group reactive with a curing agent, for example, a reactive group, such as a hydroxyl, carboxyl, or amino group, or alternatively by adding the above reactive group to the above resin, with a curing agent, such as a polyisocyanate compound, a polymethylol compound, an epoxy compound, or a chelate compound. Further, it is also possible to use a product of a reaction of curing agents with each other. The cured receptive layer is advantageous also in that, even when additives, such as ultraviolet absorbers and antistatic agents, are added thereto, the cured receptive layer is less likely to be influenced by the additives because part of the receptive layer is in a cured state.

Further, after the formation of the receptive layer containing a curing agent, a receptive layer not containing any curing agent may be provided thereon. Any combination of receptive layer resins may be possible. In this case, the coverage of the outermost layer should be not more than 1.5 $g/m^2$, particularly preferably not more than 1.0 $g/m^2$. When the coverage exceeds 1.5 $g/m^2$, roughening of the surface of the receptive layer in its high-density printing area cannot be prevented.

Further, pigments and fillers, such as titanium oxide, zinc oxide, kaolin clay, calcium carbonate, and finely divided silica, may also be added from the viewpoint of further enhancing the sharpness of the transferred image through an improvement in whiteness of the receptive layer. In the case of a sheet for OHP, however, the amount of the pigment or additive should be such that the transparency necessary for OHP is not lost.

The receptive layer is formed by coating on the intermediate layer either a solution of a mixture of the resin with necessary additives in a suitable organic solvent or a dispersion of the above mixture in an organic solvent or water by coating means, for example, gravure printing, screen printing, reverse-roll coating using a gravure plate and drying the resultant coating.

The receptive layer thus formed may have any thickness, generally a thickness in the range of from 1 to 50 μm.

Back surface layer

A back surface layer may be provided on the back surface of the thermal transfer image-receiving sheet from the viewpoint of improving the capability of the sheet to be smoothly carried in a machine and preventing curling.

The back surface layer may be formed of a mixture of a resin, such as acrylic resin, cellulosic resin, polycarbonate resin, polyvinyl acetal resin, polyvinyl alcohol resin, polyamide resin, polystyrene resin, polyester resin, or halogenated polymer, with an additive, for example, an organic filler, such as acrylic filler, nylon filler, Teflon filler, or polyethylene wax or an inorganic filler, such as silicon dioxide or metal oxide.

A conductive intermediate layer of the same type as that provided on the side of the receptive layer may be provided between the back surface layer and the substrate sheet. The provision of this layer can impart a stable antistatic property also to the back surface side.

Surface layer

The surface layer is formed on both the outermost surfaces. The surface layer containing a conductive material may be formed of a dispersion of fine particles of a metal oxide, such as zinc oxide, titanium oxide, or tin oxide, in a resin, for example, a polyolefin resin, such as polypropylene, a halogenated polymer, such as polyvinyl chloride or polyvinylidene chloride, a vinyl resin, such as polyvinyl acetate or a polyacrylic ester, a polyester resin, such as polyethylene terephthalate or polybutylene terephthalate, a polystyrene resin, a polyamide resin, an ionomer, a cellulosic resin, such as cellulose acetate, a polycarbonate resin, a polyvinyl acetal resin, a polyvinyl alcohol resin, or a copolymer of the above resin or a monomer thereof, such as vinyl chloride/vinyl acetate copolymer or ethylene/vinyl acetate copolymer.

The fine particles of the metal oxide should be present in a mutually bonded state in the surface layer. For this purpose, the fine particles of the metal oxide should be incorporated in an amount of not less than 70% by weight into the surface layer.

Alternatively, the surface layer may be formed of a solution or dispersion of a fatty acid ester, a sulfuric ester, a phosphoric ester, an amide, a quaternary ammonium salt, a betaine, an amino acid, an acrylic resin, or an ethylene oxide adduct in a solvent.

In both the above cases, the coverage of the surface layer is preferably 0.001 to 0.1 $g/m^2$.

The provision of the above surface layer enables the resultant image-receiving sheet to have an excellent antistatic property, before printing, enough to prevent carrying troubles such as simultaneous feeding of a plurality of sheets. When the surface layer is absent, the antistatic property before printing is unsatisfactory and, consequently, the carrying troubles, such as simultaneous feeding of a plurality of sheets, cannot be sufficiently prevented.

Thermal transfer sheets for thermal transfer using the above thermal transfer image-receiving sheet include a dye sublimation type thermal transfer sheet used in a dye sublimation transfer recording system and, in addition, a hot melt type thermal transfer sheet, comprising a substrate bearing, coated thereon, a hot melt ink layer of a pigment or the like held by a hot melt binder, wherein upon heating the ink layer too is transferred to a material on which an image is to be transferred.

In the thermal transfer, thermal energy may be applied by any conventional means. For example, a contemplated object can be sufficiently attained by applying a thermal energy of about 5 to 100 mJ/mm$^2$ through the control of a recording time by means of a recording device, such as a thermal printer (for example, a video printer VY-100 manufactured by Hitachi, Limited).

EXAMPLES

The present invention will now be described in more detail with reference to the following examples and comparative examples.

Example 1

Preparation of thermal transfer image-receiving sheet:

A coating solution, for a conductive intermediate layer 1, having the following composition was coated by roll coating on a transparent substrate sheet (surface resistivity on the side of receptive layer: $10^{10}$ Ω/□, surface resistivity on the side of back surface: $10^{10}$ Ω/□) of a 100 μm-thick polyester film (Lumirror U-94, manufactured by Toray Industries, Inc.) both surfaces of which had been subjected to antistatic treatment. The coverage was 1.0 g/m$^2$ (on a dry basis).

| Conductive intermediate layer 1 | |
|---|---|
| Antistatic resin (Elecond PQ-50B, manufactured by Soken Chemical Engineering Co., Ltd.) | 100 parts by weight |
| Toluene | 300 parts by weight |
| Methyl ethyl ketone | 300 parts by weight |

A coating solution, for a receptive layer 1, having the following composition was coated on the intermediate layer by roll coating. The coverage was 4.0 g/m$^2$ (on a dry basis).

| Receptive layer 1 | |
|---|---|
| Polyester resin (Vylon 200, manufactured by Toyobo Co., Ltd.) | 50 parts by weight |
| Vinyl chloride/vinyl acetate copolymer (VAGH, manufactured by Union Carbide) | 50 parts by weight |
| Amino-modified silicone (KF-393, manufactured by The Shin-Etsu Chemical Co., Ltd.) | 3 parts by weight |
| Epoxy-modified silicone (X-22-343, manufactured by The Shin-Etsu Chemical Co., Ltd.) | 3 parts by weight |
| Stearic acid (18 carbon atoms, boiling point 232° C., melting point 72° C.) | 5 parts by weight |
| Toluene | 300 parts by weight |
| Methyl ethyl ketone | 300 parts by weight |

Further, a coating solution, for a back surface layer 1, having the following composition was coated by roll coating on the surface of the substrate remote from the receptive layer. The coverage was 4.0 g/m$^2$ (on a dry basis).

| Back surface layer 1 | |
|---|---|
| Acrylic polyol (Acrylic A-815-45, manufactured by Dainippon Ink and Chemicals, Inc.) | 100 parts by weight |
| Curing agent (Coronate 2030, manufactured by Nippon Polyurethane Industry Co., Ltd.) | 10 parts by weight |
| Acrylic filler (MR-7G, manufactured by Soken Chemical Engineering Co., Ltd.) | 1 part by weight |
| Toluene | 100 parts by weight |
| Methyl ethyl ketone | 100 parts by weight |

Further, a coating solution, for an antistatic agent layer, having the following composition was coated by roll coating on both the outermost surfaces of the resultant image-receiving sheet. The coverage was 0.02 g/m$^2$ (on a dry basis).

| Antistatic agent layer | |
|---|---|
| Antistatic agent (Statisid, manufactured by Takihara Sangyo Kaisha, Ltd.) | 1 part by weight |
| Isopropanol | 1000 parts by weight |

Example 2

A thermal transfer image-receiving sheet was prepared in the same manner as in Example 1, except that a coating solution, for a conductive intermediate layer 2, having the following composition was used instead of the coating solution for a conductive intermediate layer 1 in Example 1. The coverage of the intermediate layer 2 was 1.0 g/m$^2$ (on a dry basis).

| Conductive intermediate layer 2 | |
|---|---|
| Antistatic resin (Jurymer SP-50TF, manufactured by Nihon Junyaku Co., Ltd.) | 80 parts by weight |
| Polyvinyl alcohol (Gosenol N-300, manufactured by Nippon Synthetic Chemical Industry Co., Ltd.) | 20 parts by weight |
| Isopropanol | 50 parts by weight |
| Water | 250 parts by weight |

Example 3

A thermal transfer image-receiving sheet was prepared in the same manner as in Example 1, except that the following second intermediate layer 1 was formed between the conductive intermediate layer 1 and the receptive layer 1. The coverage of the second intermediate layer 1 was 4.0 g/m$^2$ (on a dry basis).

| Second intermediate layer 1 | |
|---|---|
| Vinyl chloride/vinyl acetate copolymer (glass-transition temperature 65° C.) (Denka Vinyl #1000MT$_2$, manufactured by Denki Kagaku Kogyo K.K.) | 50 parts by weight |
| Toluene | 150 parts by weight |
| Methyl ethyl ketone | 150 parts by weight |

Example 4

A thermal transfer image-receiving sheet was prepared in the same manner as in Example 3, except that a coating solution, for a receptive layer 2, having the following composition was used instead of the coating solution for a receptive layer 1 of Example 3.

| Receptive layer 2 | |
|---|---|
| Polyester resin (Vylon 200, manufactured by Toyobo Co., Ltd.) | 50 parts by weight |
| Vinyl chloride/vinyl acetate/vinyl alcohol copolymer (Denka Vinyl #1000GK, manufactured by Denki Kagaku Kogyo K.K.) | 50 parts by weight |
| Amino-modified silicone (KF-393, manufactured by The Shin-Etsu Chemical Co., Ltd.) | 3 parts by weight |
| Epoxy-modified silicone (X-22-343, manufactured by The Shin-Etsu Chemical Co., Ltd.) | 3 parts by weight |
| Stearic acid (carbon atoms 18, boiling point 232° C., melting point 72° C.) | 5 parts by weight |
| Chelate curing agent (Orgatix TC-100, manufactured by Matsumoto Trading Co., Ltd.) | 5 parts by weight |
| Toluene | 300 parts by weight |
| Methyl ethyl ketone | 300 parts by weight |
| Isopropanol | 50 parts by weight |

Example 5

A thermal transfer image-receiving sheet was prepared in the same manner as in Example 3, except that a coating solution, for a second intermediate layer 2, having the following composition was used instead of the second intermediate layer of Example 3.

| Second intermediate layer 2 | |
|---|---|
| Vinyl chloride/vinyl acetate copolymer (glass transition temperature 50° C.) (Denka Vinyl #1000D, manufactured by Denki Kagaku Kogyo K.K.) | 50 parts by weight |
| Toluene | 150 parts by weight |
| Methyl ethyl ketone | 150 parts by weight |

Comparative Example 1

A thermal transfer image-receiving sheet was prepared in the same manner as in Example 1, except that the provision of an antistatic layer on both the outermost surfaces of the image-receiving sheet was omitted.

Comparative Example 2

A thermal transfer image-receiving sheet was prepared in the same manner as in Example 1, except that no conductive intermediate layer was provided.

Comparative Example 3

A thermal transfer image-receiving sheet was prepared in the same manner as in Comparative Example 2, except that a substrate sheet was used which had been subjected to no antistatic treatment. For the substrate sheet which had been subjected to no antistatic treatment, the resistivity of the surface on the receptive layer side was not less than $10^{15}$ Ω/□, while the resistivity of the surface on the back layer side was not less than $10^{15}$ Ω/□.

Comparative Example 4

A thermal transfer image-receiving sheet was prepared in the same manner as in Comparative Example 1, except that a substrate sheet was used which had been subjected to no antistatic treatment. For the substrate sheet which had been subjected to no antistatic treatment, the resistivity of the surface on the receptive layer side was not less than $10^{15}$ Ω/□, while the resistivity of the surface on the back layer side was not less than $10^{15}$ Ω/□.

The thermal transfer image-receiving sheets of the present invention and the comparative thermal transfer image-receiving sheets prepared above and a commercially available thermal transfer sheet were put on top of the other so that the receptive layer faced the dye layer. The laminate was heated by means of a thermal head through the back surface of the thermal transfer sheet.

Heating conditions were such that recording was carried out under conditions of an applied voltage of 12 V and a pulse width of 16 msec and solid printing was carried out by putting three colors of yellow, magenta, and cyan on top of one another. The results are given in the following Tables 1 and 2.

Properties listed in Tables 1 and 2 were evaluated by the following methods.

(1) Surface resistivity

Measuring device: Hiresta IP, an ohm-meter for high resistance manufactured by Mitsubishi Petrochemical Co., Ltd.

Measuring environment: Temperature 25° C. and humidity 50%

(2) Saturated electrification voltage and half value period

Measuring device: Static Honestmeter H-0110, manufactured by Shishido Electrostatic, Ltd.

Measuring environment: Temperature 25° C. and humidity 50%

Applied voltage: 6 kV (3) Storage stability

Hundred image-receiving sheets were put on top of one another, and they were stored in an oven at 60° C. for 100 hr. When no adhesion was observed between the image-receiving sheets, the storage stability was evaluated as O; when adhesion was observed for 1 to 49 image-receiving sheets, the storage stability was evaluated as Δ; and when adhesion was observed for not less than 50 image-receiving sheets, the storage stability was evaluated as X.

TABLE 1

| | | Surface resistivity (Ω/□) | | Saturated electrification voltage (kV) | | | |
|---|---|---|---|---|---|---|---|
| | | | | Before printing | | After printing | |
| | | Before printing | After printing | + | − | + | − |
| Ex. | 1 | $2 \times 10^9$ | $2 \times 10^{11}$ | 0.4 | 0.4 | 0.8 | 0.8 |
| | 2 | $3 \times 10^9$ | $3 \times 10^{11}$ | 0.4 | 0.4 | 1.0 | 1.0 |
| | 3 | $3 \times 10^9$ | $3 \times 10^{11}$ | 0.4 | 0.4 | 1.2 | 1.2 |
| | 4 | $3 \times 10^9$ | $3 \times 10^{11}$ | 0.4 | 0.4 | 1.2 | 1.2 |
| | 5 | $3 \times 10^9$ | $3 \times 10^{11}$ | 0.4 | 0.4 | 1.2 | 1.2 |
| Comp. Ex. | 1 | $5 \times 10^{11}$ | $5 \times 10^{11}$ | 1.5 | 1.7 | 1.5 | 1.7 |
| | 2 | $5 \times 10^9$ | Not less than $10^{13}$ | 0.5 | 0.5 | 2.8 | 2.5 |
| | 3 | $8 \times 10^9$ | Not less than $10^{13}$ | 0.5 | 0.5 | Not less than 3 | Not less than 3 |
| | 4 | $7 \times 10^{11}$ | $7 \times 10^{11}$ | 1.7 | 1.9 | 1.7 | 1.9 |

The image-receiving sheets having a surface resistivity of not less than $10^{11}$ Ω/□ before printing caused a trouble that a plurality of sheets are simultaneously fed under low temperature and low humidity conditions (for example, temperature 10° C. and humidity 20%). The image-receiving sheets having a surface resistivity of not less than $10^{13}$ Ω/□ after printing caused a carrying trouble during printing.

The image receiving sheets having a saturated electrification voltage of not less than +1.5 kV or not more than −1.5 kV before printing caused a trouble that a plurality of sheets were simultaneously fed under low temperature and low humidity conditions (for example, temperature 10° C. and humidity 20%). The image-receiving sheets having a saturated electrification voltage of not less than +2.5 kV or not more than −2.5 kV after printing caused a carrying trouble during printing.

TABLE 2

| | Half value period (sec) | | | | |
|---|---|---|---|---|---|
| | Before printing | | After printing | | Storage |
| | + | − | + | − | stability |
| Ex. 1 | Not more than 1 | Not more than 1 | 5 | 7 | Δ |
| 2 | Not more than 1 | Not more than 1 | 7 | 9 | Δ |
| 3 | Not more than 1 | Not more than 1 | 7 | 9 | ○ |
| 4 | Not more than 1 | Not more than 1 | 7 | 9 | ○ |
| 5 | Not more than 1 | Not more than 1 | 7 | 9 | x |
| Comp. Ex. 1 | 20 | 30 | 20 | 30 | Δ |
| 2 | Not more than 1 | Not more than 1 | Not less than 180 | Not less than 180 | ○ |
| 3 | Not more than 1 | Not more than 1 | Not less than 180 | Not less than 180 | ○ |
| 4 | 50 | 70 | 50 | 70 | Δ |

The image-receiving sheets having a half value period of not less than 50 sec before printing caused a trouble that, in the course of printing after rubbing, a plurality of sheets are simultaneously fed. The image-receiving sheets having a half value period of not less than 180 sec after printing caused a phenomenon that print samples were mutually adhered due to static electricity.

Comparative Examples 5 and 6

In order to demonstrate the superiority of the present invention, properties of the thermal transfer image-receiving sheets disclosed in Japanese Patent Laid-Open No. 82597/1991 and Japanese Patent Laid-Open No. 33894/1992 referred to in the above column of "BACKGROUND OF INVENTION" were compared with those of the thermal transfer image-receiving sheet of the present invention. In the following comparative data, the thermal transfer image-receiving sheet of the present invention used is a thermal transfer image-receiving sheet prepared in Example 4. For Japanese Patent Laid-Open No. 82597/1991, a thermal transfer image-receiving sheet disclosed in Example 13 of the specification thereof was used. Further, for Japanese Patent Laid-Open No. 33894/1992, a thermal transfer image-receiving sheet disclosed in Example 1 of the specification thereof was used. Therefore, descriptions of Japanese Patent Laid-Open No. 82597/1991 and Japanese Patent Laid-Open No. 33894/1992 used for comparison are incorporated herein by reference.

TABLE 3

| Sample (before printing) | Environment | Surface resistivity (Ω/□) | Applied voltage | Saturated electrification voltage | Half value period |
|---|---|---|---|---|---|
| Invention (Ex. 4) | 25° C./50% | $3.0 \times 10^9$ | +8 KV | +0.9 KV | 7.8 sec |
| | | | −8 KV | −0.6 KV | 15.8 sec |
| Japanese Patent Laid-Open No. 82597/1991 (Ex. 13) | | $1.8 \times 10^{10}$ | +8 KB | +1.0 KV | OVER 180 sec |
| | | | −8 KV | −1.3 KV | OVER 180 sec |
| Japanese Patent Laid-Open No. 33894/1992 (Ex. 1) | | $2.6 \times 10^{10}$ | +8 KV | +2.1 KV | OVER 180 sec |
| | | | −8 KV | −1.4 KV | OVER 180 sec |

According to the present invention, a thermal transfer image-receiving sheet can be provided which is not influenced by environmental conditions, such as temperature and humidity, and always exhibits stable antistatic effect and carriability during and even after the formation of an image.

We claim:

1. A thermal transfer image-receiving sheet comprising:

a substrate sheet having a surface resistivity of not more than $1\times10^{12}$ Ω/□ as measured under environmental conditions of 20° C. and 50% humidity;

a first conductive layer provided on one surface of said substrate sheet;

a receptive layer provided on said first conductive layer; and a second conductive layer containing a conductive material, said second conductive layer being provided on both the surface of said receptive layer and the other surface of said substrate sheet.

2. The thermal transfer image-receiving sheet according to claim 1, wherein an intermediate layer having a glass transition temperature of 60° C. or above is provided between said substrate sheet and said first conductive layer and/or between said first conductive layer and said receptive layer.

3. The thermal transfer image-receiving sheet according to claim 1, wherein said receptive layer comprises a cured resin layer.

4. The thermal transfer image-receiving sheet according to claim 2, wherein said receptive layer comprises a cured resin layer.

5. The thermal transfer image-receiving sheet according to claim 1, wherein said first conductive layer comprises a resin with a group having an antistatic property being introduced in a pendant form into at least part of a polymer constituting the resin.

6. An OHP sheet comprising the thermal transfer image-receiving sheet of claim 1.

* * * * *